US006708428B2

(12) United States Patent
Chen

(10) Patent No.: US 6,708,428 B2
(45) Date of Patent: Mar. 23, 2004

(54) QUICK-RELEASE CONNECTOR SYSTEM FOR FOOTWEAR WITH RELIABLE ENGAGEMENT

(76) Inventor: Ming-Chi Chen, No. 33, Lih der East Street, Taichung (TW)

( * ) Notice: Subject to any disclaimer, the term of this patent is extended or adjusted under 35 U.S.C. 154(b) by 16 days.

(21) Appl. No.: 10/217,773

(22) Filed: Aug. 13, 2002

(65) Prior Publication Data

US 2004/0031171 A1 Feb. 19, 2004

(51) Int. Cl.[7] ..... A43B 5/00; A43C 15/00

(52) U.S. Cl. ..... 36/134; 36/67 D; 36/65; 36/59 R

(58) Field of Search ..... 36/134, 127, 128, 36/67 R, 67 A, 67 D, 65, 59 R

(56) References Cited

U.S. PATENT DOCUMENTS 5,036,606 A * 8/1991 Erich et al. ..... 36/134
5,321,901 A * 6/1994 Kelly ..... 36/134
5,524,367 A * 6/1996 Ferreira et al. ..... 36/134
5,655,317 A * 8/1997 Grant ..... 36/134
5,974,700 A * 11/1999 Kelly ..... 36/134
6,463,682 B1 * 10/2002 Carroll, Jr. ..... 36/134
6,631,571 B2 * 10/2003 McMullin ..... 36/134

* cited by examiner

*Primary Examiner*—Anthony D. Stashick
(74) *Attorney, Agent, or Firm*—Eric K. Satermo

(57) ABSTRACT

A cleat holder is fixed to an underside of footwear and comprises a base and a hub projecting from. The hub includes a plurality of lobes on an outer periphery thereof and a screw-threaded bore. Grooves are defined in a side of the base, each groove having a portion extending to an indentation between two adjacent lobes. A shoe cleat comprises a cleat body and a screw-threaded spigot projecting from the cleat body. The screw-threaded spigot is releasably engageable with the screw-threaded bore of the cleat holder through rotary insertion. Protrusions are formed on a side of the cleat body and located around the screw-threaded spigot. Each protrusion of the shoe cleat is retained in place by an associated groove and an associated indentation of the cleat holder when the screw-threaded spigot is in the engaged position.

4 Claims, 10 Drawing Sheets

QUICK-RELEASE CONNECTOR SYSTEM FOR FOOTWEAR WITH RELIABLE ENGAGEMENT

BACKGROUND OF THE INVENTION

1. Field of the Invention

The present invention relates to a quick-release connector system for footwear with reliable engagement. In particular, the present invention relates to a shoe cleat that can be quickly attached to or detached from a cleat holder fixed in an underside of footwear while providing a reliable engagement between the shoe cleat and the cleat holder.

2. Description of the Related Art

Shoe cleats attached to an underside of footwear are useful in providing a reliable engagement with grass or soft soil, thereby preventing slip. For example, the shoe cleats allow a golfer to swing the golf club without the risk of slip in the feet. Metal spikes are hardly used now, as they damaged the grass and provided insufficient grounding effect. Further, the metal spikes caused an uncomfortable feeling while walking, as the reactive force from the ground was transmitted through a point back to the foot of the wearer. FIG. 2 of the drawings illustrates a conventional shoe cleat 12 made of rubber and FIG. 1 illustrates a shoe having a plurality of shoe cleats 12 attached to an underside of a sole 2 thereof. The shoe cleat 12 includes a plurality of spaced ground-engaging spikes 10, providing the required grounding effect and friction. The reactive force from the ground is distributed in a uniform manner, providing a comfort wearing for the wearer. Referring to FIG. 2, the shoe cleat 12 includes a threaded spigot 13 for threading engagement with a holder 11 embedded in the underside of the sole 2.

Different spikes provide different grounding effect and friction. Thus, the shoe cleats are sometimes changed in response to the terrain and weather. However, detachment/attachment of the shoe cleats is troublesome. Quick-release connector systems have been proposed in e.g., U.S. Pat. Nos. 5,768,809, 6,108,944, and 6,332,281, all to Savoie, U.S. Pat. Nos. 5,974,700 and 6,272,774, both to Kelly, and U.S. Pat. No. 5,123,184 to Ferreira. The shoe cleats can be easily, threadedly engaged with the cleat holders by turning the respective cleat through a small angle. However, it was found that the cleats were apt to be disengaged from the cleat holders, as the engaging force between the shoe cleats and the cleat holders are poor.

SUMMARY OF THE INVENTION

An object of the present invention is to provide a shoe cleat that can be quickly attached to or detached from a cleat holder fixed in an underside of footwear while providing a reliable engagement between the shoe cleat and the cleat holder.

A quick-release connector system for footwear in accordance with the present invention comprises a cleat holder fixed in an underside of footwear and a shoe cleat. The cleat holder comprises a base and a hub projecting from a side of the base. The hub includes a plurality of lobes on an outer periphery thereof and a screw-threaded bore. Each two of the lobes adjacent to each other have an indentation therebetween. A plurality of grooves are defined in the side of the base, each groove having a portion extending to the indentation between two of the lobes that are adjacent to each other.

The shoe cleat comprises a cleat body, a screw-threaded spigot projecting from a side of the cleat body, and a spike unit formed on another side of the cleat body. The screw-threaded spigot is releasably engageable with the screw-threaded bore of the cleat holder through rotary insertion between a released position and an engaged position. A plurality of spaced protrusions are formed on the side of the cleat body and located around the screw-threaded spigot. Each protrusion of the shoe cleat is retained in place by an associated one of the grooves and an associated one of the indentations of the cleat holder when the screw-threaded spigot is in the engaged position.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
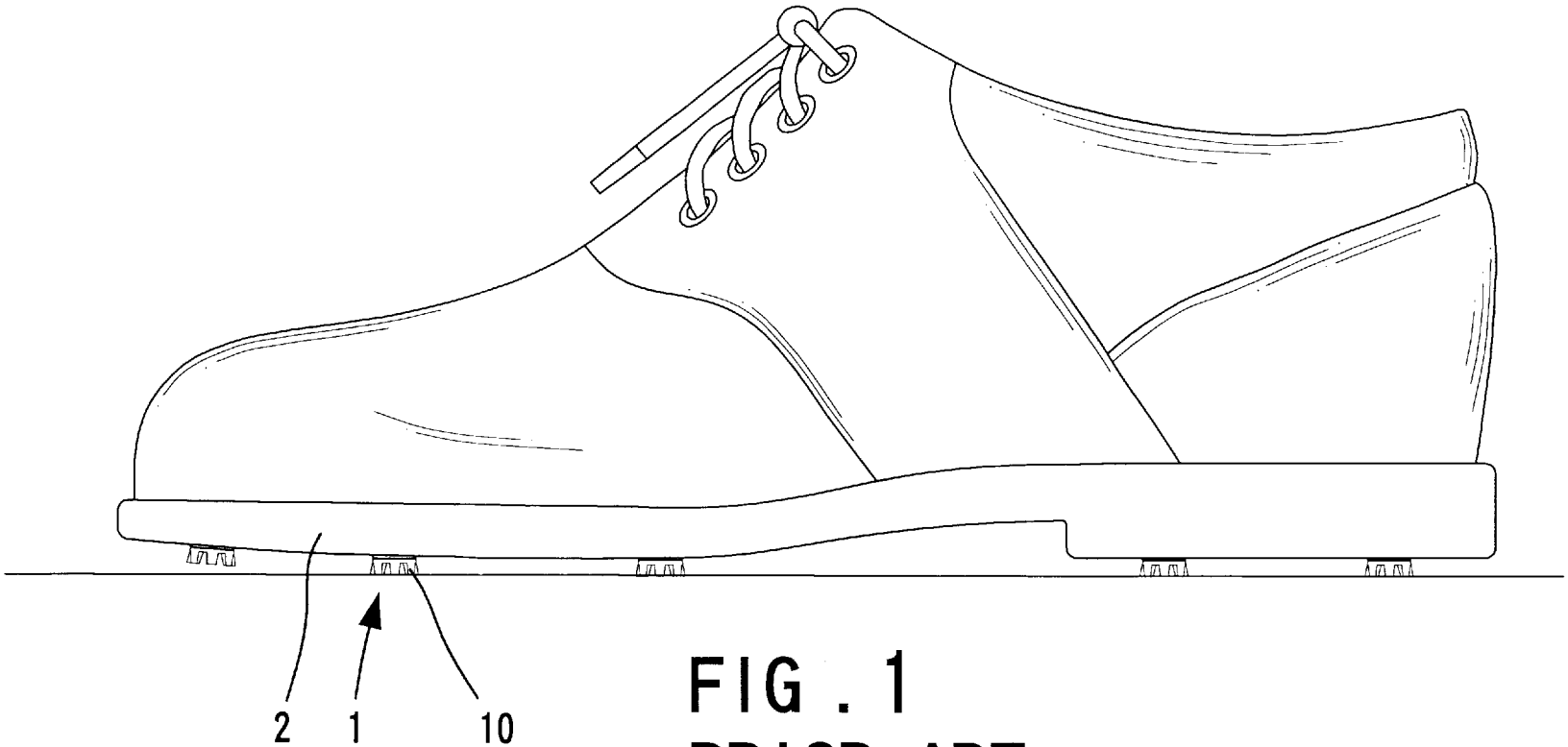
FIG. 1 PRIOR ART
FIG. 1 is a side view of a shoe having conventional shoe cleats attached thereto.
Figure 2:
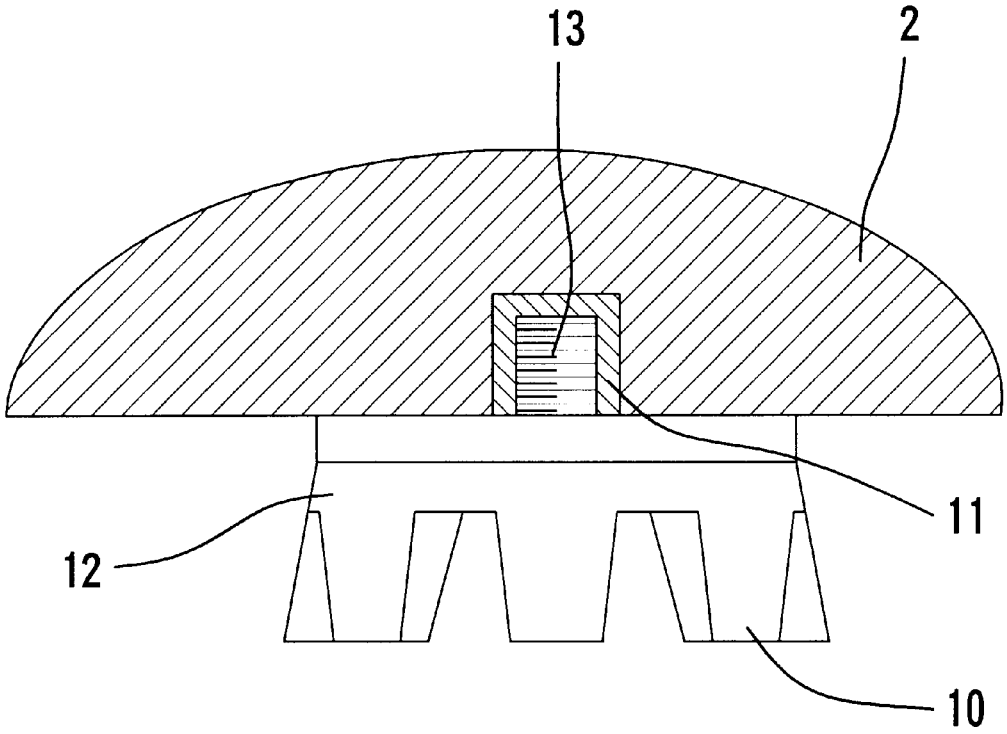
FIG. 2 PRIOR ART
FIG. 2 is an enlarged side view, partly in section, of a shoe cleat and a cleat holder fixed in a sole of the shoe in FIG. 1.
Figure 3:
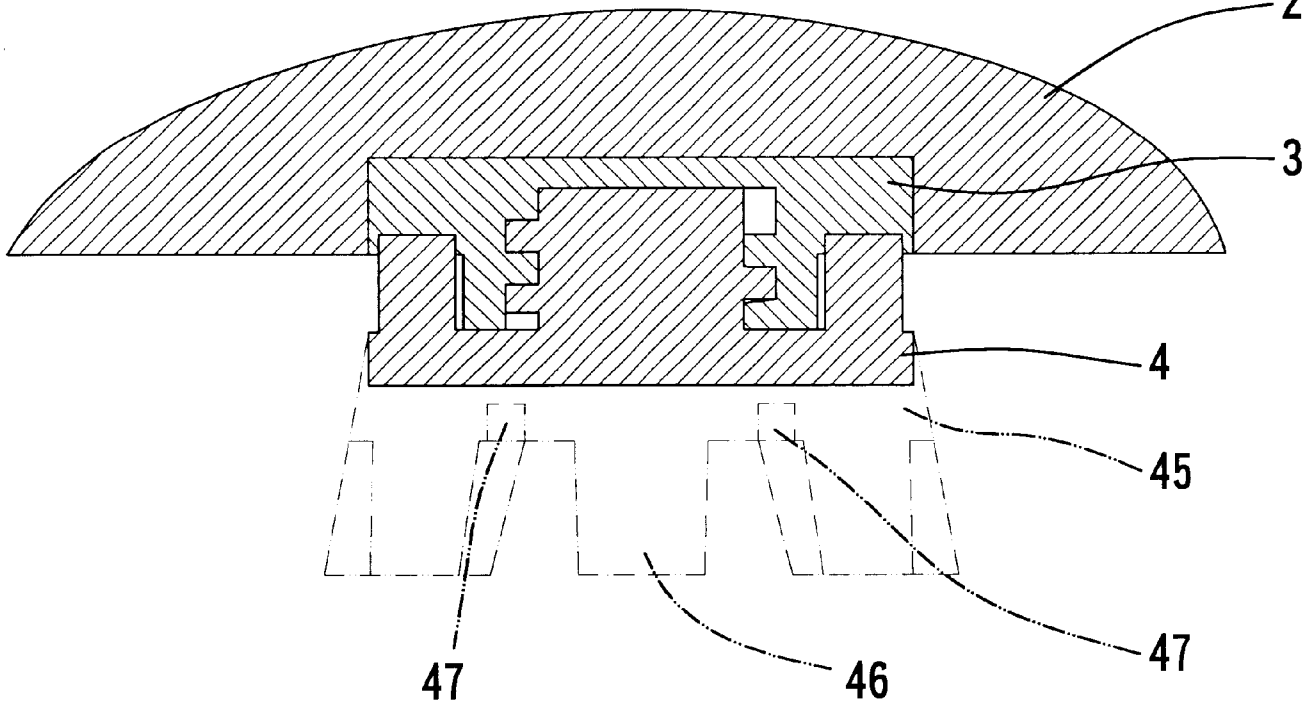
FIG. 3 is an enlarged sectional view of a shoe cleat and a cleat holder in accordance with the present invention.

Referring to FIG. 3, a quick-release connector system for footwear with reliable engagement in accordance with the present invention generally comprises a shoe cleat 4 and a cleat holder 3 that is fixed to an underside of footwear, e.g., a sole 2 of a sport shoe.

Figure 4:
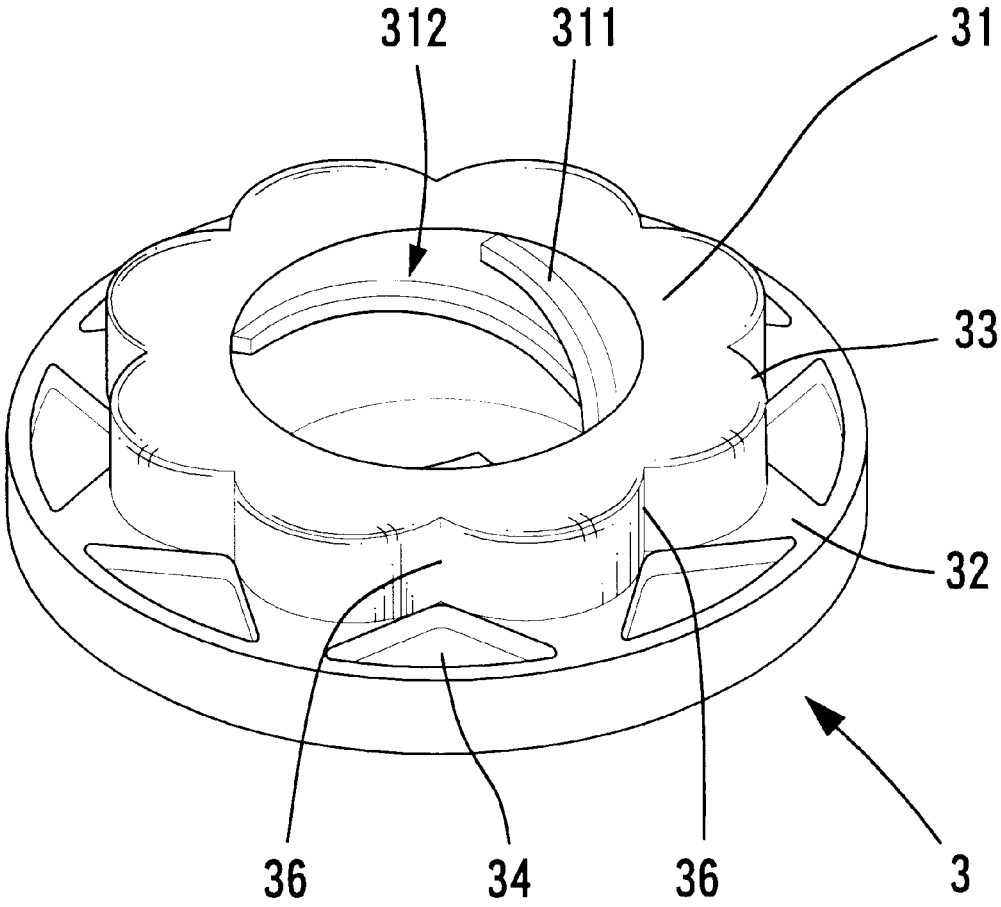
FIG. 4 is a perspective view of the cleat holder in accordance with the present invention.

Referring to FIG. 4, the cleat holder 3 comprises a base 32 and a hub 31 projecting from a side of the base 32. The hub 31 includes a plurality of lobes 33 on an outer periphery thereof and a screw-threaded bore 312. In this embodiment, three spaced helical threads 311 are formed on an inner periphery defining the screw-threaded bore 312. Further, a plurality of grooves 34 is defined in the side of the base 32, each groove 34 having a portion extending to an indentation 36 between two lobes 33 that are adjacent to each other.

Figure 5:
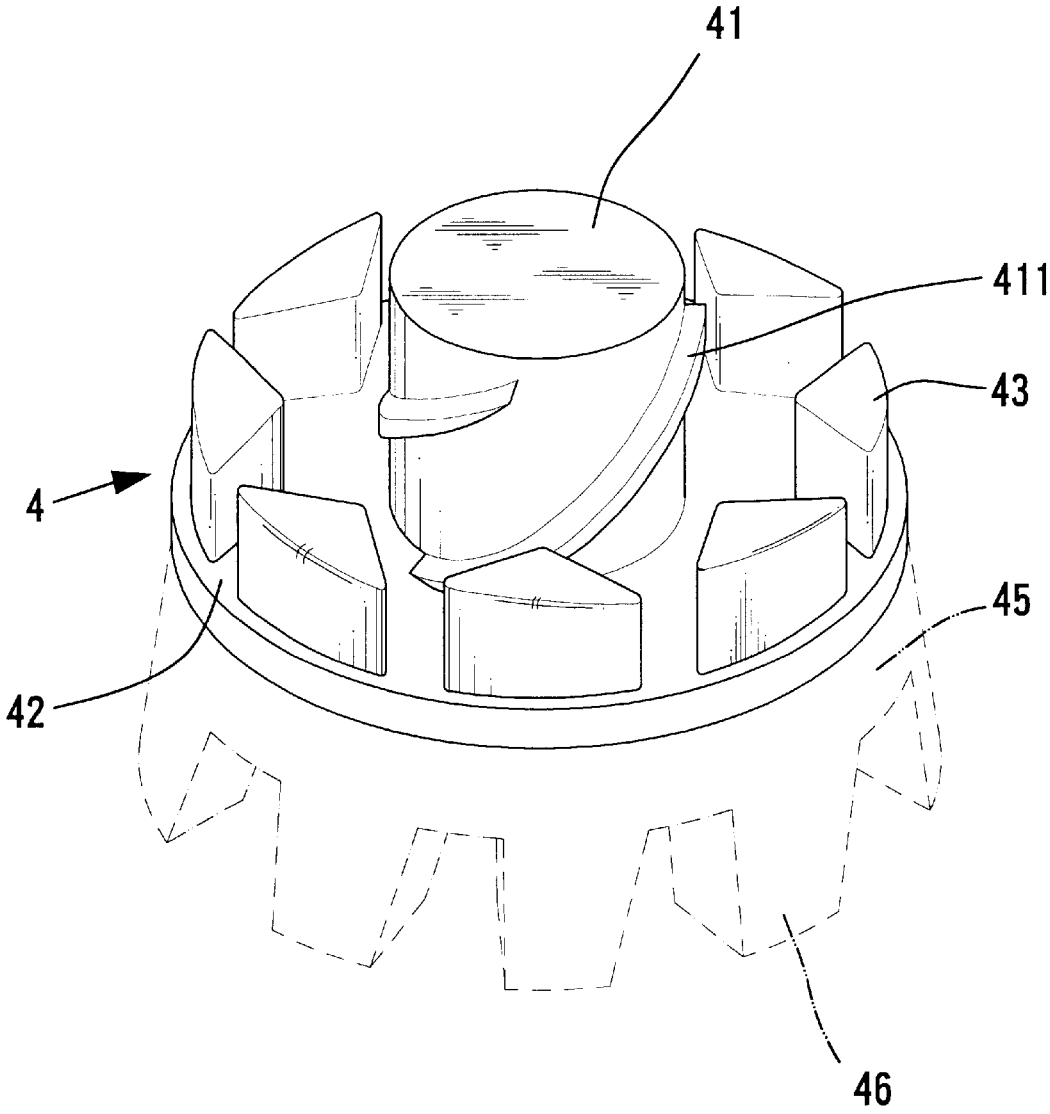
FIG. 5 is a perspective view of the shoe cleat in accordance with the present invention.

Referring to FIG. 5, the shoe cleat 4 includes a cleat body 42, a screw-threaded spigot 41 projecting from a side of the cleat body 42, and a spike unit 45 formed on the other side of the cleat body 42. In this embodiment, three spaced helical threads 411 corresponding to the helical threads 311 of the cleat holder 31 are formed on an outer periphery of the screw-threaded spigot 41. Thus, the screw-threaded spigot 41 of the cleat 4 is releasably engageable with the screw-threaded bore 312 of the cleat holder 3 through rotary insertion. Further, a plurality of spaced protrusions 43 are formed on the side of the cleat body 42 and located around the screw-threaded spigot 41. The spike unit 45 includes a plurality of ground-engaging spikes 46 on an underside thereof. The spike unit 45 and the cleat 42 may be integrally formed with each other by injection molding.

Figure 6:
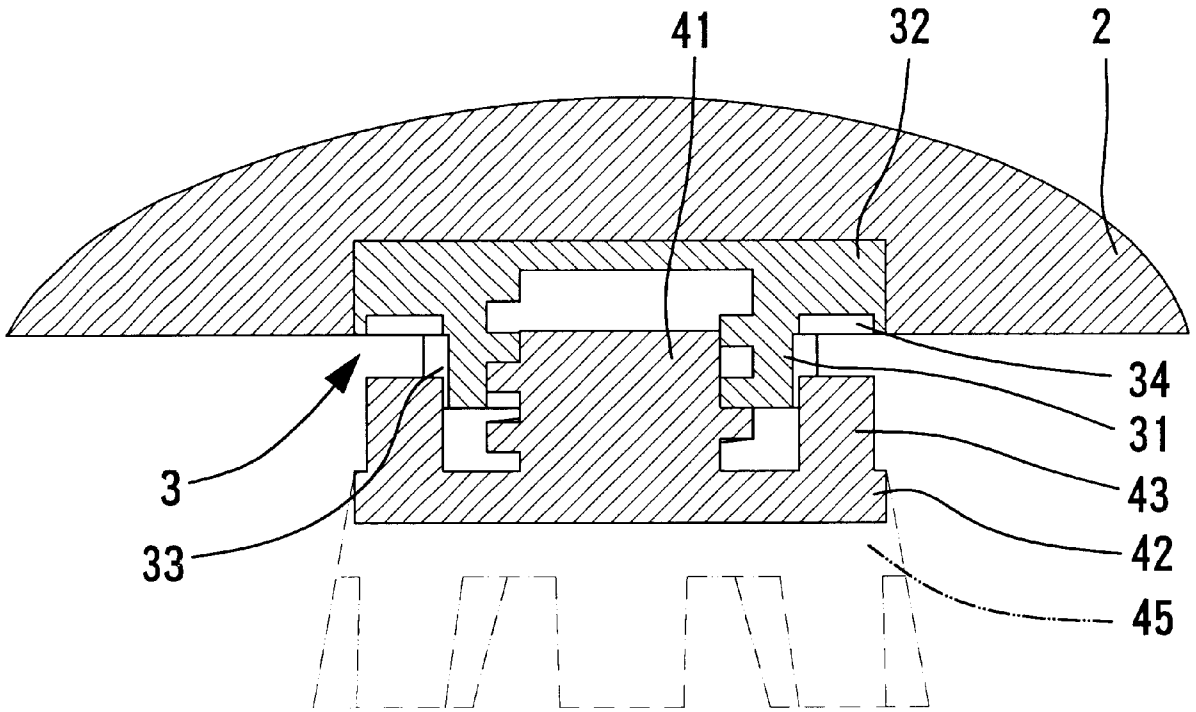
FIG. 6 is a sectional view similar to FIG. 3, wherein the shoe cleat is in a position ready for engaging with the cleat holder.
Figure 7:
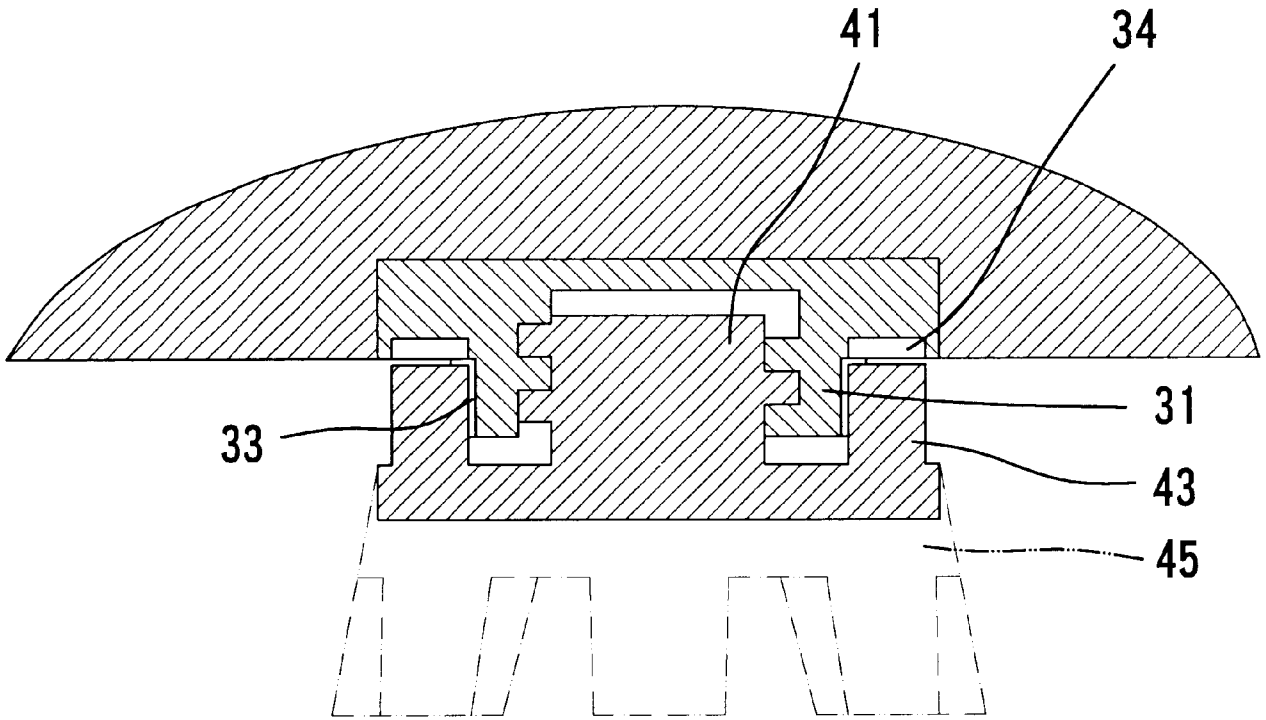
FIG. 7 is a sectional view similar to FIG. 6, wherein the shoe cleat is turned through an angle.

In assembly, referring to FIG. 6, the screw-threaded spigot 41 of the shoe cleat 4 is aligned with and inserted into the screw-threaded bore 312 of the cleat holder 3. Next, the shoe cleat 4 is turned through an angle such that the helical threads 411 of the screw-threaded spigot 41 are engaged with the helical threads 312 of the screw-threaded bore 312, as shown in FIG. 7. It is noted that each protrusion 43 of the shoe cleat 4 is engaged in an indentation 36 between two lobes 33 that are adjacent to each other. Further rotation of the shoe cleat 4 allows the protrusion 43 to move across the next lobe 33 into the next indentation 36, and each protrusion 43 is engaged into an associated groove 34 of the cleat holder 3, best shown in FIG. 8.

Figure 8:
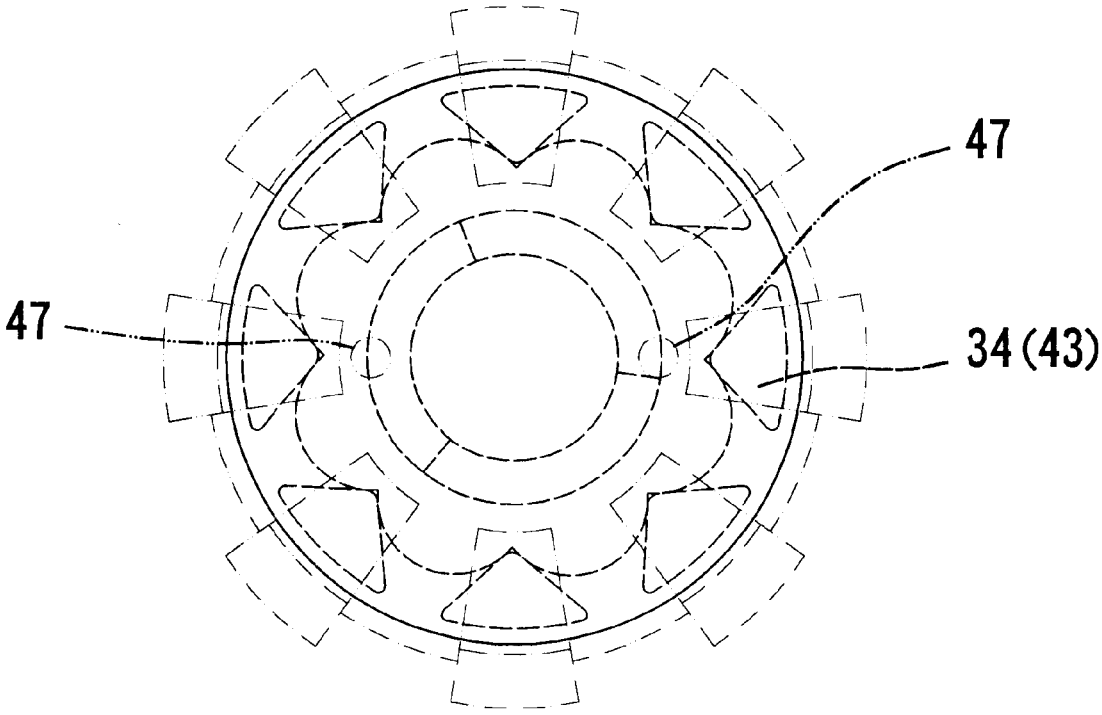
FIG. 8 is a plan view of the shoe cleat and cleat holder in FIG. 3.

Thus, each protrusion 43 on the shoe cleat 4 is retained in its engaged position by the associated indentation 36 between two lobes 33 and the associated groove 34 of the cleat holder 3, as shown in FIG. 8. The engagement between the shoe cleat 4 and the cleat holder 3 is reliable. Attachment of the shoe cleat 4 to the cleat holder 3 is easily achieved by manually turning the shoe cleat 4 through a relatively small angle. Detachment of the shoe cleat 4 from the cleat holder 3 can be achieved by means of extending two engaging legs (not shown) of a tool (not shown) into two engaging holes 47 (see FIGS. 3 and 8) and then turning the tool in a reverse direction to a released position, thereby disengaging the protrusions 43 from the grooves 34 and the indentations 36 of the cleat holder 3 for subsequent removal of the shoe cleat 4 from the cleat holder 3.

Figure 9:
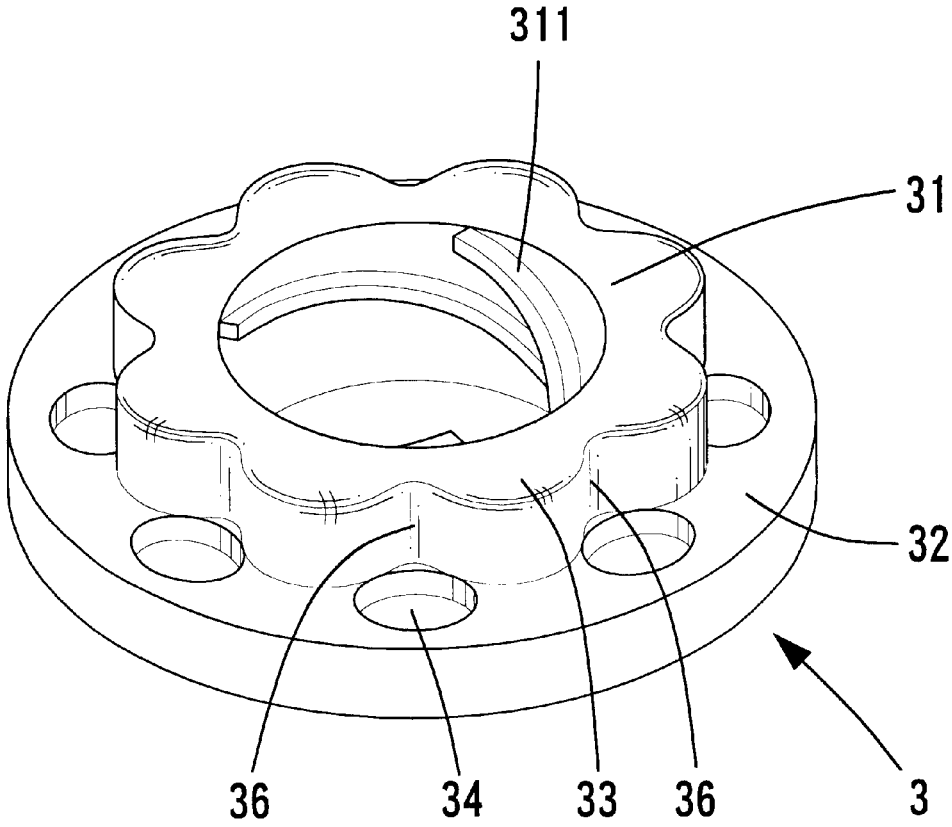
FIG. 9 is a perspective view of another embodiment of the cleat holder in accordance with the present invention.
Figure 10:
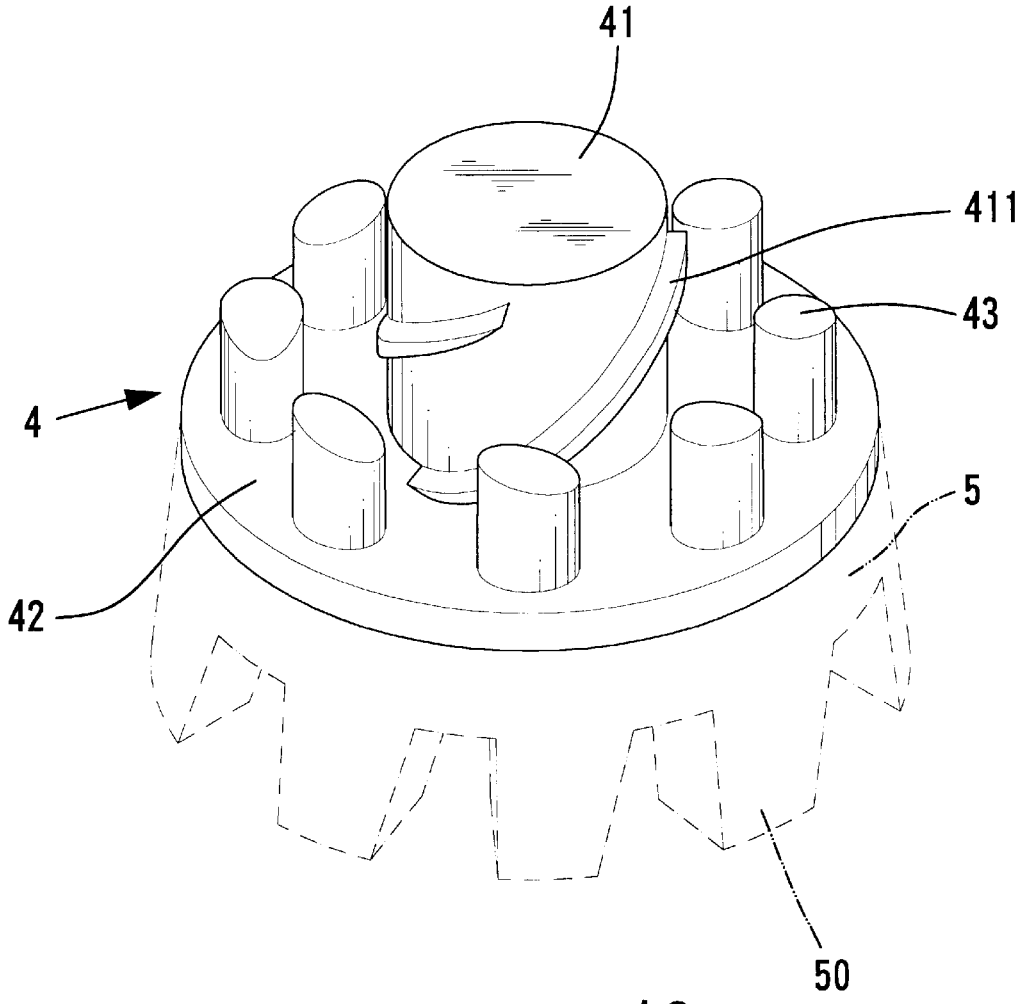
FIG. 10 is a perspective view of another embodiment of the cleat holder in accordance with the present invention.

The grooves 34 of the cleat holder 3 and the protrusions 43 of the shoe cleat 4 are triangular in the first embodiment shown in FIGS. 4 and 5. Nevertheless, the grooves 34 and the protrusions 43 may be of any other shapes. For example, the grooves 34 may be circular and the protrusions 43 may be cylindrical, as illustrated in FIGS. 9 and 10. The shoe cleat 4 in FIG. 10 also includes a cleat body 42, a screw-threaded spigot 41 projecting from a side of the cleat body 42, and a spike unit 5 formed on the other side of the cleat body 42. The spike unit 5 includes a plurality of ground-engaging spikes 50 on an underside thereof Similar to the first embodiment, each protrusion 43 on the shoe cleat 4 is retained in place by the associated indentation 36 between two lobes 33 and the associated groove 34 of the cleat holder 3.

Although the invention has been explained in relation to its preferred embodiment, it is to be understood that many other possible modifications and variations can be made without departing from the scope of the invention as hereinafter claimed.

What is claimed is:

1. A quick-release connector system for footwear, comprising:

a cleat holder fixed in an underside of footwear, the cleat holder comprising a base and a hub projecting from a side of the base, the hub including a plurality of lobes on an outer periphery thereof and a screw-threaded bore, each two of said lobes adjacent to each other having an indentation therebetween, a plurality of grooves being defined in the side of the base, each said groove having a portion extending to the indentation between two of said lobes that are adjacent to each other; and a shoe cleat comprising a cleat body, a screw-threaded spigot projecting from a side of the cleat body, and a spike unit formed on another side of the cleat body, the screw-threaded spigot being releasably engageable with the screw-threaded bore of the cleat holder through rotary insertion between a released position and an engaged position, a plurality of spaced protrusions being formed on the side of the cleat body and located around the-screw-threaded spigot;

wherein each said protrusion of the shoe cleat is retained in place by an associated one of the grooves and an associated one of the indentations of the cleat holder when the screw-threaded spigot is in the engaged position.

2. The quick-release connector system for footwear as claimed in claim 1, wherein the grooves of the cleat holder and the protrusions of the shoe cleat are triangular.

3. The quick-release connector system for footwear as claimed in claim 1, wherein the grooves of the cleat holder are circular and the protrusions of the shoe cleat are cylindrical.

4. The quick-release connector system for footwear as claimed in claim 1, wherein the screw-threaded spigot includes at least two helical threads on an outer periphery thereof, and wherein the cleat holder includes at least two helical threads on an inner periphery defining the screw-threaded bore.

* * * * *